United States Patent [19]

Henrit

[11] 4,208,942

[45] Jun. 24, 1980

[54] COMBINATION DRUM TUNING KEY AND CYMBAL HOLDER

[75] Inventor: Robert Henrit, Winchmore Hill, England

[73] Assignee: A. Zildjian Export Co., Inc., Norwell, Mass.

[21] Appl. No.: 21,339

[22] Filed: Mar. 19, 1979

[51] Int. Cl.[2] ..... G10G 7/00; G10G 5/00

[52] U.S. Cl. ..... 84/421; 81/121 R; 84/459; 85/32 V; 85/32 W

[58] Field of Search ..... 81/121 R; 84/411–422, 84/453, 458, 459; 85/32 V, 32 W

[56] References Cited

U.S. PATENT DOCUMENTS

| | | | |
|---|---|---|---|
| 151,797 | 6/1874 | Rawson | 84/411 R |
| 1,344,318 | 6/1920 | Slye et al. | 84/459 |
| 2,132,105 | 10/1938 | Gladstone | 84/411 R |
| 2,525,386 | 10/1950 | Van Winkle | 81/121 R |
| 3,139,783 | 7/1964 | Grant et al. | 84/411 R |
| 3,524,413 | 8/1970 | Veasman | 85/32 V |

*Primary Examiner*—Lawrence R. Franklin
*Attorney, Agent, or Firm*—Kenway & Jenney

[57] ABSTRACT

A combination drum tuning key and cymbal holder is made of an integral T-shaped tool having a handle connected to a barrel, the barrel defining a square-shaped internal cavity for drum tuning, the internal walls of the cavity also being grooved so that the tool can be threadedly attached to the threaded end of a stand to secure a cymbal.

7 Claims, 7 Drawing Figures

COMBINATION DRUM TUNING KEY AND CYMBAL HOLDER

BACKGROUND OF THE INVENTION

The invention relates generally to tools for musical instruments and particularly to a combination drum tuning and cymbal holding tool.

Among the musical instruments that can trace their history furthest back are the percussion instruments. The most familar of the percussion instruments are drums and cymbals, instruments that have taken many forms over the years. Percussion instruments are used in symphony orchestras to play classical music, as well as in small musical groups and bands to play popular music.

The typical unit of percussion instruments for musical groups or bands is a compact arrangement of several drums and cymbals. The cymbals are often arranged on stands where they can be manipulated by drum sticks or brushes, or by foot pedals. Typically a cymbal is secured to the supporting stand by a wing nut threaded onto the threaded tip of the stand that projects through a hole in the cymbal. The nut is not a permanent fixture on the stand, but is removed for disassembly and storage of the cymbal and stand. It is usually kept with the disassembled unit and used again when the unit is reassembled.

Most drums in a percussion unit are tuned, by varying the drum head tension to have an effect on the sound produced. The drum head is attached to a ring that is connected in several places to tightening screws that in turn are threadedly connected to mountings on the drum body. Turning these screws varies the tension of the drum head and turning the screws at different locations on the ring has different effects on the sound produced on the drum. Occassionally each screw has a turning handle of its own. But more often, because of the number of tuning screws on a drum, perhaps a dozen or more, the tuning screws end in a square-shaped head with which a tuning key is used. The tuning key has a square-shaped hole to match the square-shaped cross section of the tuning screw head. The tuning key is slid on the turning screw head, the screw is turned, and the key is removed.

The tuning key is small and portable; it can easily be lost. Keeping the tuning key available can be a serious problem. The key can of course be attached in some way to the instrument, but then it has to be released in order to use it. It can also detract from the appearance of the instrument to which it is attached, or at least require elaborate efforts to make its attachment to the drum simple and attractive.

Accordingly, it is an object of the invention to provide a tuning key that need not be attached to a drum but is readily available for use.

It is another object of the invention to provide as a drum tuning key some tool that may ordinarily be kept with another percussion instrument in the vicinity of the drum.

It is a further object of the invention to provide a combination drum tuning key and cymbal holder.

It is a still further object of the invention to provide a combination tool for tuning drums and securing cymbals that is attractive, inexpensive to make, and easy to use and maintain.

SUMMARY OF THE INVENTION

The invention comprises a hand tool with a barrel having an internal cavity of a square cross-section for operating the tuning screw heads on a drum, the barrel furthermore being internally threaded so that the tool can be used as a nut to secure cymbals on the threaded ends of cymbal stands. The handle is curved to orient and support the hand when the handle is turned in the clockwise direction.

DETAILED DESCRIPTION OF THE PREFERRED EMBODIMENT

Figure 1:
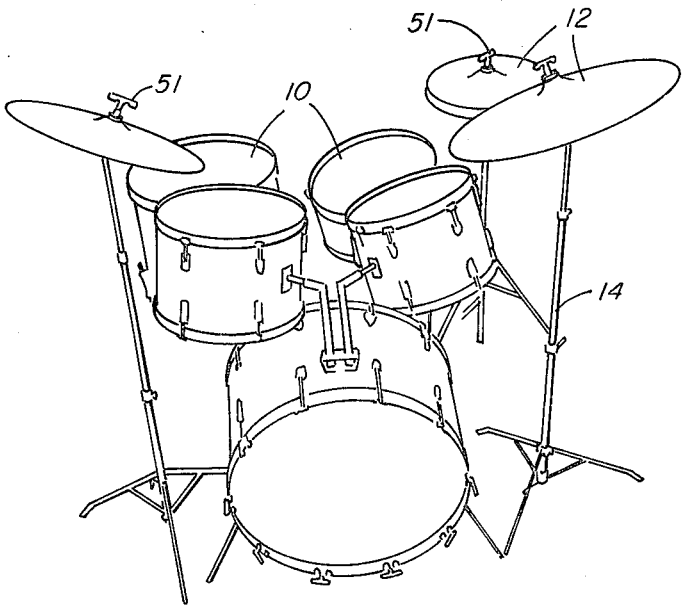
FIG. 1 is a perspective view of an arrangement of typical percussion instruments for a band.

FIG. 1 shows a typical arrangment of percussion instruments for a small band, designed for maximum operation by one person. A cluster of drums 10 of different types form the center of the arrangement, and cymbals 12 are arranged on stands 14 at the periphery. To a certain extent it is an arrangement of assembled instruments. The cymbals 12, for example, may be disassembled from the stands 14 and the drums 10 may be disassembled from connection to each other.

Figure 2:
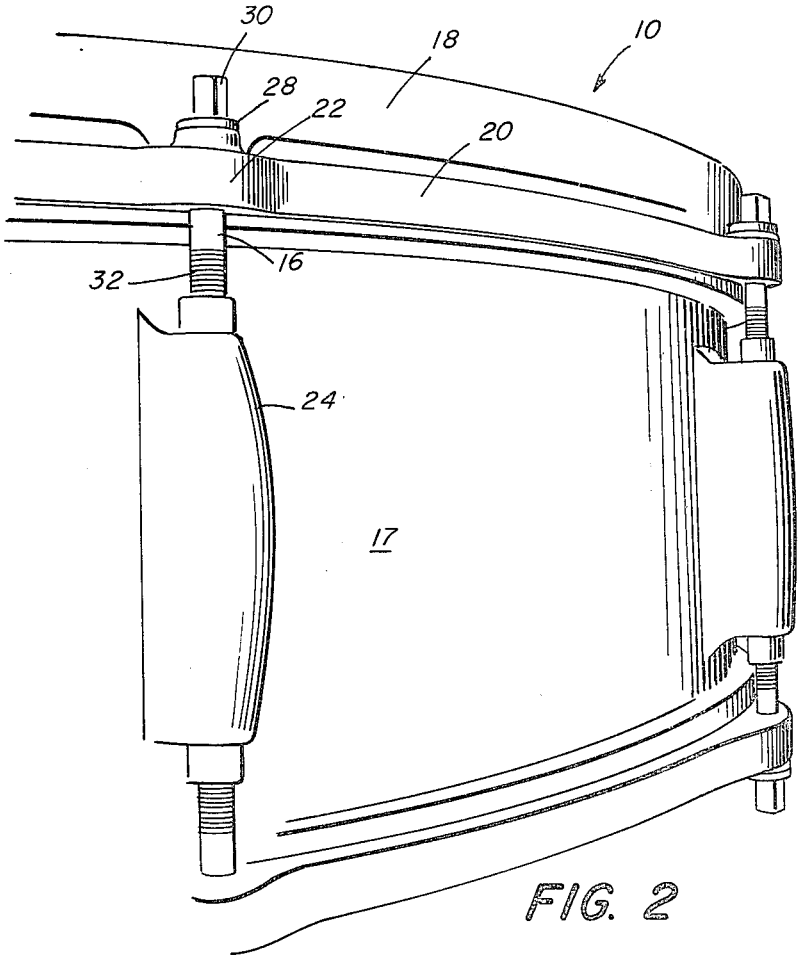
FIG. 2 is a detailed perspective view of the tuning unit on a drum.

FIG. 2 shows, in detail, a typical arrangement for tuning the drums 10. The drums 10 are tuned by tightening or loosening threaded screws 16. The drum head 18 is attached to a ring 20. The ring 20 has holes 22 at several points through which the threaded screws 16 pass to be threadedly connected to mountings 24 on the drum body 17. Each screw 16 has a collar 28 beyond which it has a projecting head 30 with a square cross-section. It is rotatably mounted in the ring hole 22, its threaded portion 32 threadedly connected to the mounting. Turning the square-shaped projecting head 30 one way or the other moves the threaded end 32 of the screw 16 in or out of the mounting 24, pulling down or releasing the pressure on the ring 20 and hence on the drum head 18. This drum tuning arrangement is conventional and well known to those skilled in the art.

Figure 3:
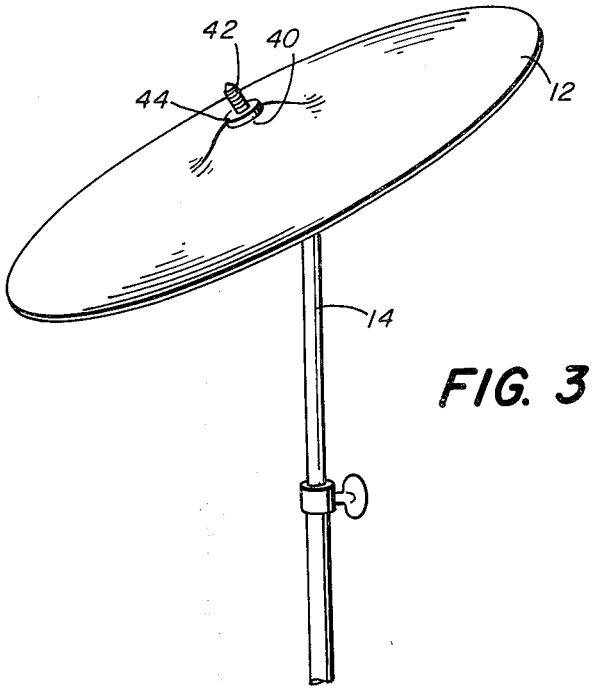
FIG. 3 is a detailed perspective view of the end of a cymbal stand.
Figure 4:
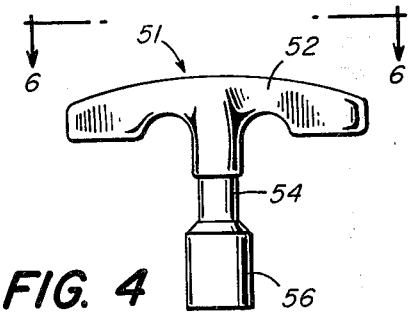
FIG. 4 is an elevation view of a tool embodying the invention.
Figure 5:
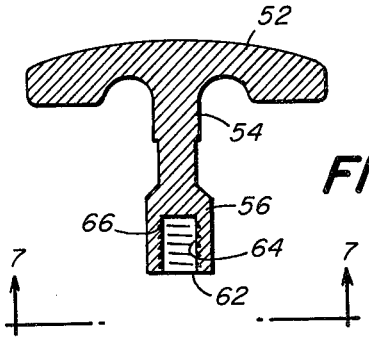
FIG. 5 is a cross-sectional view of the same tool.

FIG. 3 shows the mounting, or securing, arrangement for a cymbal 12. The cymbal 12 has a hole 40 in its center. It is applied over the threaded end 42 of a typical cymbal stand 14. A rubber grommet 44 may be used. Ordinarily a wing nut (not shown) is threadedly secured to the projecting end 42 to secure the cymbal 12 in place. The threaded end 42 of the stand typically has a diameter similar in dimension to the width of the tuning head 30.

Figure 6:
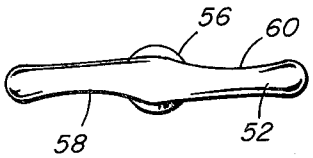
FIG. 6 is a top view of the tool.
Figure 7:
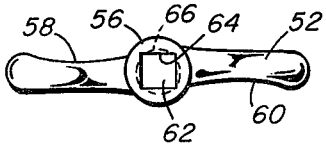
FIG. 7 is a bottom view of the tool.

The tool 51 of the invention is shown in the next four views, FIGS. 3–7. The tool 51 is in an integral piece of metal that may be finished in chrome to enhance its attractiveness. Its general shape is that of a T. The T-shape consists of a turning handle 52 attached at its central portion transversely to a shank 54 leading to a bottom barrel portion 56. As shown in FIG. 6, the handle 52 may be curved to fit the fingers more comfortably when the tool is being rotated in the clockwise direction since the tightening direction, clockwise, usually requires more pressure by the fingers. Therefore the extending portions of the handle 52 are curved slightly to meet the thumb at the surface 58 and curved to meet the other fingers at the surface 60 in a comfortable concave shape when the tool 51 is grasped to turn it in the clockwise direction. The surface opposite the curved surfaces 58 and 60 on the handle projections are not curved in a concave fashion, helping to orient quickly, by touch, the person gripping the tool, so that the person knows the direction in which to tighten.

The barrel portion 56 of the tool has an internal elongate cavity 62 that is square-shaped in cross section and extends inwardly along the barrel axis from the end of the barrel. In the typical tool 51 the width of the cavity 62 might be about ¼ of an inch. The length of the cavity 62 would likely be in that case about ½ of an inch. The outside dimension, or diameter, of the barrel 56 would be about ⅜ of an inch. The cross section of the cavity 62 conforms to the square-shaped head 30 of the drum tuning screws 16. The dimensions are such that it may slidably mate with the head 30 easily yet seat firmly to turn the screw 16.

The cavity 62 is defined by internal walls 64. Parallel grooves 66 spaced apart in a direction transverse to the barrel end, corresponding to a circular thread like that of a nut, are formed in the cavity walls 64, to the extent that such a circular thread would overlap the walls defining the square shape of the cavity 62. Since the cavity 62 is square shaped rather than circular, the grooves 66 do not necessarily present a continuous thread arrangement like that of a typical nut formed only for the purpose of mounting on a threaded rod. The grooves 66 are, however, adequate for the application contemplated for the tool 51, namely, to secure a cymbal 12 to a stand 14.

In use, a tool 51 is provided to secure each cymbal 12 to the top of its stand 14 by threadedly engaging the threaded end 42 of the stand. When it is desired to tune one or more of the drums 10, the tool 51 may be unscrewed from the cymbal stand 14. The tool 51 may then be used as a drum tuning key in the usual fashion, namely, it is slid over the square shaped tuning screw head 30 and turned clockwise to tighten the drum head 18 at that particular location, or counterclockwise to loosen it. The tool 51 can be used on successive tuning screws 16, or, if desired, several tools can be used at the same time at different locations.

After using the tool 51 to tune the drums 10, it can be returned to securing the cymbals 12 to the stands 14.

The tool 51 can be used, of course, only if the square-shaped tuning screw heads 30 and the threaded portion 42 at the end of the cymbal stands 14 are close enough in dimension so that the combined effect of the barrel of the tool is feasible. That is, the diameter of the threaded end 42 must be just slightly larger than the width of the square-shaped tuning heads 30, so that the barrel cavity 62 is large enough for the head 30 but there is also an opportunity to put grooves 66 in the cavity walls 64 to form threads will match threaded end 42. In most cases the dimensions are close, and in any event it is a relatively simple matter to arrange one or the other dimension so that this condition exists. For example, if drum tuning screw heads 30 are usually ¼ inch square, the cymbal stand threaded end portion 42 can be made by the cymbal stand manufacturer to have a thread with a diameter slightly larger than ¼ inch.

Having described the embodiment, I set forth the following claims to define my invention.

I claim:

1. Combination drum tuning key and cymbal holder comprising a handle and a barrel portion with an axis connected to said handle, said barrel having internal walls defining a cavity extending inwardly along said axis from an end of said barrel, the cavity being square in cross section and adapted to turn a drum tuning screw head, said interior walls of said cavity also being threaded for threaded attachment to the circular threaded end of a cymbal stand.

2. The tool of claim 1 in which the handle is arranged transversely to said barrel axis to form a T-shaped tool.

3. The tool of claim 1 or 2 in which said combination is an integral metal unit.

4. A combination drum tuning and cymbal holding tool for use with drum tuning screws having heads of square-shaped cross section and with threaded cymbal securing rods in which said rods have diameters slightly larger than the width of said tuning head, comprising:

a barrel having opposite ends and internal walls defining an elongate cavity extending inwardly from one said end of said barrel, said cavity being square in cross section and adapted to slidably mate with said drum tuning screw head, each said internal wall of said cavity forming a plurality of parallel grooves spaced apart in a direction transverse to said barrel end, said grooves being arranged to threadedly engage said threaded cymbal securing rod.

5. The combination drum tuning and cymbal holding tool claimed in claim 4 further including a handle, said handle being connected to the other said end of said barrel.

6. The combination drum timing and cymbal holding tool claimed in claim 5 in which said handle is elongate and has a central portion, said handle being connected to said barrel at its said central portion and arranged so that said handle is transverse to said elongate cavity in said barrel.

7. The combination drum tuning and cymbal holding tool claimed in claim 5 in which said elongate handle has two portions extending from said central portion, said two portions each having a surface defining a concave surface portion arranged so that when said handle is gripped by a hand to turn said barrel in the clockwise direction, the thumb of the hand rests on one of said concave surface portions and the remaining fingers on the other said concave surface portion.

* * * * *